US006686696B2

(12) United States Patent
Mearini et al.

(10) Patent No.: US 6,686,696 B2
(45) Date of Patent: Feb. 3, 2004

(54) MAGNETRON WITH DIAMOND COATED CATHODE

(75) Inventors: Gerald T. Mearini, Shaker Heights, OH (US); Laszlo A. Takacs, Shaker Heights, OH (US)

(73) Assignee: Genvac Aerospace Corporation, Richmond Heights, OH (US)

( * ) Notice: Subject to any disclaimer, the term of this patent is extended or adjusted under 35 U.S.C. 154(b) by 39 days.

(21) Appl. No.: 09/802,585

(22) Filed: Mar. 8, 2001

(65) Prior Publication Data

US 2002/0125827 A1 Sep. 12, 2002

(51) Int. Cl.[7] ..... H01J 23/05; H01J 25/50

(52) U.S. Cl. ..... 315/39.63; 315/39.71; 315/103 R; 315/309

(58) Field of Search ..... 315/39.51, 39.63, 315/39.67, 39.71; 313/103 R, 309, 326, 351

(56) References Cited

U.S. PATENT DOCUMENTS

| | | | | |
|---|---|---|---|---|
| 2,513,933 A | * | 7/1950 | Gurewitsch | 313/309 X |
| 3,109,123 A | * | 10/1963 | Spencer | 315/39.63 |
| 3,403,281 A | * | 9/1968 | Weaver | 315/39.63 X |
| 5,280,218 A | * | 1/1994 | Smith | 315/39.51 X |
| 5,796,211 A | | 8/1998 | Graebner et al. | 315/3.5 |
| 5,908,699 A | * | 6/1999 | Kim | 313/326 X |
| 5,945,778 A | * | 8/1999 | Jaskie | 313/351 X |
| 6,005,347 A | * | 12/1999 | Lee | 313/103 R |

OTHER PUBLICATIONS

J.P. Calame et al., "Applications of Advanced Materials Technologies to Vacuum Electronic Devices", Proceedings of the IEEE, vol. 87. No. 5, May, 1999.

John A. Nation et al., "Advances in Cold Cathode Physics and Technology", Proceedings of the IEEE, vol. 87, No. 5, May 1999.

* cited by examiner

*Primary Examiner*—Benny T. Lee
(74) *Attorney, Agent, or Firm*—Fay, Sharpe, Fagan, Minnich & McKee, LLP

(57) ABSTRACT

A radio frequency magnetron device for generating radio frequency power includes a cathode at least partially formed from a diamond material. An anode is disposed concentrically around the cathode. An electron field is provided radially between the anode and the cathode. First and second oppositely charged pole pieces are operatively connected to the cathode for producing a magnetic field in a direction perpendicular to the electric field. A filament is provided within the electron tube which when heated produces primary electrons. Alternatively, a voltage is applied to the anode which causes primary electrons to emit from the diamond coated cathode. A portion of the primary electrons travel in a circular path and induce radio frequency power. Another portion of the primary electrons spiral back and collide with the cathode causing the emission of secondary electrons. The secondary electron emission sustains operation of the magnetron device once the device has been started.

23 Claims, 2 Drawing Sheets

MAGNETRON WITH DIAMOND COATED CATHODE

BACKGROUND OF THE INVENTION

1. Field of the Invention

The present invention relates generally to the art of cross-field microwave electron tubes for converting electron potential energy into high efficiency microwave energy. More specifically, the present invention relates to a radio frequency (RF) magnetron or microwave power tube that utilizes chemical vapor deposited (CVD) diamond as the cathode to increase the secondary electron emission of the magnetron during operation.

2. Discussion of the Prior Art

Most all vacuum electron tubes require a physical source of electrons which are typically provided by some method of electron emission. General electron emission can be analogized to the ionization of a free atom. Prior to ionization, the energy of electrons in an atom is lower than electrons at rest in a vacuum. In order to ionize the atom, energy must be supplied to the electrons in the atom. That is, the atom fails to spontaneously emit electrons unless the electrons are provided with energy greater than or equal to the electrons at rest in a vacuum. Energy can be provided by numerous means, such as by heat or irradiation with light. When sufficient energy is imparted to the atom, ionization occurs and the atom releases one or more electrons.

Several types of electron emission are known. Thermionic emission involves an electrically charged particle emitted by an incandescent substrate (as in a vacuum tube or incandescent light bulb.) Photoemission releases electrons from a material by means of energy supplied by incidence of radiation, especially light. Electron injection involves the emission of electrons from one solid to another. Field emission refers to the emission of electrons due to the application of an electric field to a cathode. Finally, secondary emission occurs by bombardment of a substance with charged particles such as electrons or ions.

A magnetron is one known type of microwave electron tube which generally utilizes the methods of thermionic emission and secondary emission to generate electrons. Magnetrons typically have a cylindrical symmetry. On the central axis is a hollow cylindrical cathode having pole pieces, such as magnets, disposed at each of its axial ends. The outer surface of the cathode carries electron-emitting materials, such as barium and strontium oxides. At a radius larger than the outer radius of the cathode is an annular anode.

In the operation of a conventional magnetron, a current is applied to the cathode which heats it to an elevated temperature in the vicinity of 1000° C. The thermionic heat source provides the necessary energy to allow primary electrons to escape from the electron-emitting materials of the cathode. An electric field is applied radially inward from the anode while a magnetic field is generated from the opposed magnets in a direction perpendicular to the electric field. The magnetic field and electric field interact to produce a cross-field configuration that causes the emitted electrons to rotate azimuthally within the magnetron. Electrons with an optimum trajectory travel in a circular pattern and induce RF power in an outer cavity of the magnetron. Electrons with insufficient energy spiral back to the cathode and collide with the cathode's surface, thereby producing secondary electrons. The secondary electrons are accelerated due to the crossed fields and become part of the electron cloud.

The secondary electron co-efficient is the number of secondary electrons that are produced due to a single electron impinging on the cathode surface. Tungsten, which is the material most commonly used as the cathode in known magnetron devices, has a secondary electron coefficient of less than 2 at the operation voltage. Once the magnetron reaches its operating level, much of the electron emission is sustained with secondary electron production. However, secondary electrons only make up approximately 60% of the overall electron emission in known magnetron devices. Thus, the cathode must be continuously heated in order to produce the remaining electrons needed for effective operation.

Magnetrons of the foregoing nature, which rely on thermionic emission for operation, have several shortcomings. First, the continuous use of an external source for generating a primary source of electrons is costly, especially in space communication applications. Second, electrons in such devices emerge from the cathode surface in all three Cartesian directions and at various angles to the surface normal causing a crossing of electron trajectories on the microscopic scale. As a result, the signal and the power generated have an abundance of electron noise which prevents the use of RF magnetrons in space communication applications. Third, the relatively high input power required for thermionic magnetrons makes their use in residential appliances, such as clothes dryers, rather costly. Finally, the necessity of heating thermionic cathodes limits the magnetron expected life, causes warm-up delays, and requires bulky ancillary equipment such as a peripheral cooling system.

U.S. Pat. No. 5,796,211 (the '211 patent) discloses a traveling wave tube (TWT) having a cathode coated with ultrafine diamonds which is said to alleviate some of the above-identified problems. However, the '211 patent is directed only to devices which rely on primary electron emission as opposed to primary and secondary electron emission. The '211 patent neither discloses nor suggests the use of a diamond coated cathode in magnetron devices. In each of the devices disclosed in the '211 patent, all of the electrons produced interact with an input signal which amplifies the electrons. There are no electrons directed back toward the cathode which produce secondary electrons. Accordingly, a primary electron producing source, such as an electric field, a heat source, etc., must be continuously applied to the cathode to generate a primary source of electrons. As noted above, the need for a continuously operating external source is quite costly.

Accordingly, a need exists to provide an RF magnetron device which overcomes the foregoing problems and others and which can sustain effective operation without an external electron generating source.

SUMMARY OF THE INVENTION

In accordance with one aspect of the present invention a radio frequency (RF) magnetron device for generating microwave power includes a cathode disposed within an electron tube. The cathode is at least partially formed from a diamond material. The diamond material is configured to emit electrons and sustain operation of the magnetron device via secondary electron emission and without assistance of a heating source. An anode is disposed concentrically around the cathode. An electron field is provided radially between the anode and the cathode. First and second oppositely charged pole pieces are operatively connected to the cathode for producing a magnetic field in a direction perpendicular to the electric field.

In accordance with another aspect of the present invention a secondary electron emitting device for a magnetron includes a cathode at least partially formed from a diamond material. The diamond material is configured to emit electrons and sustain operation of the magnetron via secondary electron emission and without assistance of a heating source.

In accordance with another aspect of the present invention a method for producing radio frequency power using a magnetron device includes coating a cathode with a diamond material. An anode is placed in a spaced relationship with the diamond coated cathode. An electric field is applied between the anode and the cathode. A magnetic field is applied perpendicular to the electric field. Primary electrons are emitted from the diamond coated cathode for initiating operation of the magnetron device. Secondary electrons are emitted from the cathode for sustaining operation of the magnetron device.

One advantage of the present invention is the provision of a magnetron device capable of sustaining operation without an external source for producing primary electrons, such as heat source, thereby significantly reducing the cost of operation.

Another advantage of the present invention is the provision of a magnetron device having a well defined electron emission which minimizes electronic noise.

Another advantage of the present invention is the provision of a magnetron device having an increased operating life.

Another advantage of the present invention is the provision of a magnetron device which eliminates warm-up delays.

Another advantage of the present invention is the provision of a magnetron device which minimizes the need for ancillary equipment.

Yet another advantage of the present invention is the provision of a magnetron device capable of emitting electrons upon application of a relatively low level of voltage.

Still another advantage of the present invention is the provision of a magnetron device having increased efficiency and output due to the high secondary electron coefficient of the diamond coated cathode.

Still other benefits and advantages of the invention will become apparent to those skilled in the art upon a reading and understanding of the following detailed specification.

BRIEF DESCRIPTION OF THE DRAWINGS

The invention may take physical form in certain parts and arrangements of parts, several embodiments of which will be described in detail in this specification and illustrated in the accompanying drawings which form a part hereof and wherein.

DETAILED DESCRIPTION OF THE PREFERRED EMBODIMENTS

Reference will now be made in detail to the present preferred embodiments of the invention, an example of which is illustrated in the accompanying drawings. While the invention will be described in connection with the preferred embodiments, it will be understood that it is not intended to limit the invention to these embodiments. On the contrary, it is intended to cover all alternatives, modifications and equivalents that may be included within the spirit and scope of the invention defined by the appended claims.

The present invention is directed toward a radio frequency (RF) magnetron device for generating microwave power capable of relying entirely upon secondary electron emission to sustain operation. In the past RF magnetron devices commonly employed a cathode formed from a tungsten or copper material. In such a configuration, secondary electrons are only capable of generating approximately 60% of the overall electron emission needed for operation. The additional 40% of the electron emission is produced through thermionic emission. As previously discussed, there are several shortcomings associated with using thermionic emission throughout operation. The present invention replaces the conventional tungsten cathode with a diamond coated cathode that is capable of sustaining 100% of the electron emission needed for continued operation without having to use a heat source.

Figure 1:
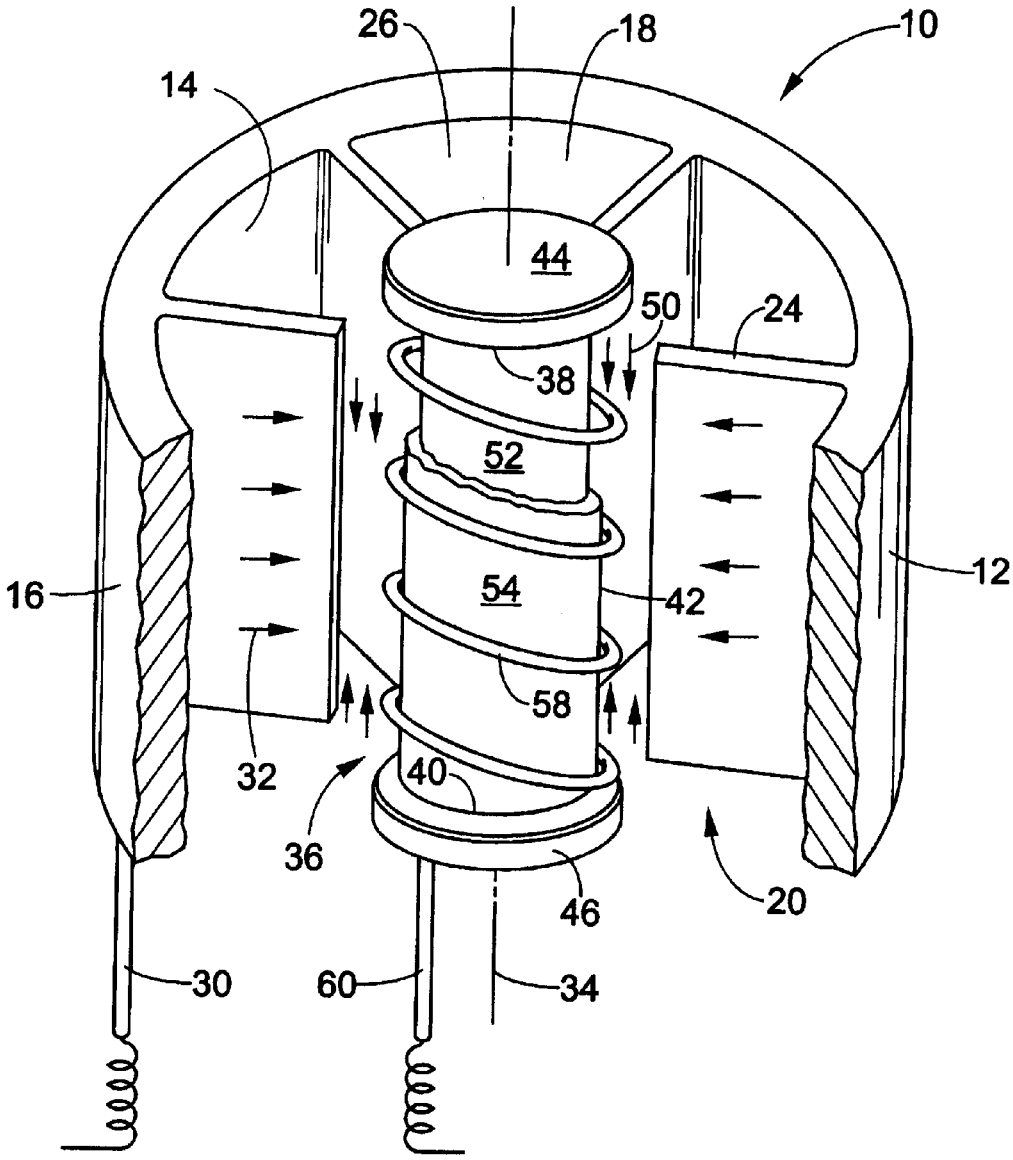
FIG. 1 is a perspective view of a radio frequency magnetron device employing a diamond coated cathode and having portions partially broken away.

With reference to FIG. 1, a RF magnetron device 10 is shown in accordance with a preferred embodiment of the present invention. The magnetron includes a substantially cylindrical or concentric anode 12 having a first inner surface 14 and a second outer surface 16. The anode is preferably fabricated from a copper material and is open at its opposed axial ends 18, 20. A plurality of vertical walls or ribs 24 extend radially inwardly from the inner surface of the anode and are preferably equally spaced from one another. The walls and the inner surface of the anode form a series of cavity resonators 26. The anode and cavity resonators serve to collect emitted electrons and store and guide microwave energy.

In the illustrated embodiment, a first voltage 30 is applied to the anode which generates a direct current electric field 32. The electric field travels in a direction radially inward and away from the inner surface 14 of the anode. Although the anode has been described with reference to a specific orientation, it must be appreciated that any conventional anode having a suitable configuration is within the scope and intent of the present invention.

On a central longitudinal axis 34 of the magnetron device is provided a cathode 36. The cathode preferably has an upper axial end 38, a lower axial end 40, and a concentric sidewall 42, all of which define a substantially cylindrical cathode configuration. A first pole piece 44 and a second pole piece 46 are mounted to the upper and lower axial ends 38, 40 respectively of the cathode. The pole pieces are preferably conventional magnets having opposite charges, but may comprise any suitable oppositely charged materials. The pole pieces function to generate an axial magnetic field 50 traveling in a direction parallel to the central longitudinal axis 34 of the magnetron device and perpendicular to the electric field. During operation, the electric field and the magnetic field interact to produce a cross-field configuration.

Figure 2:
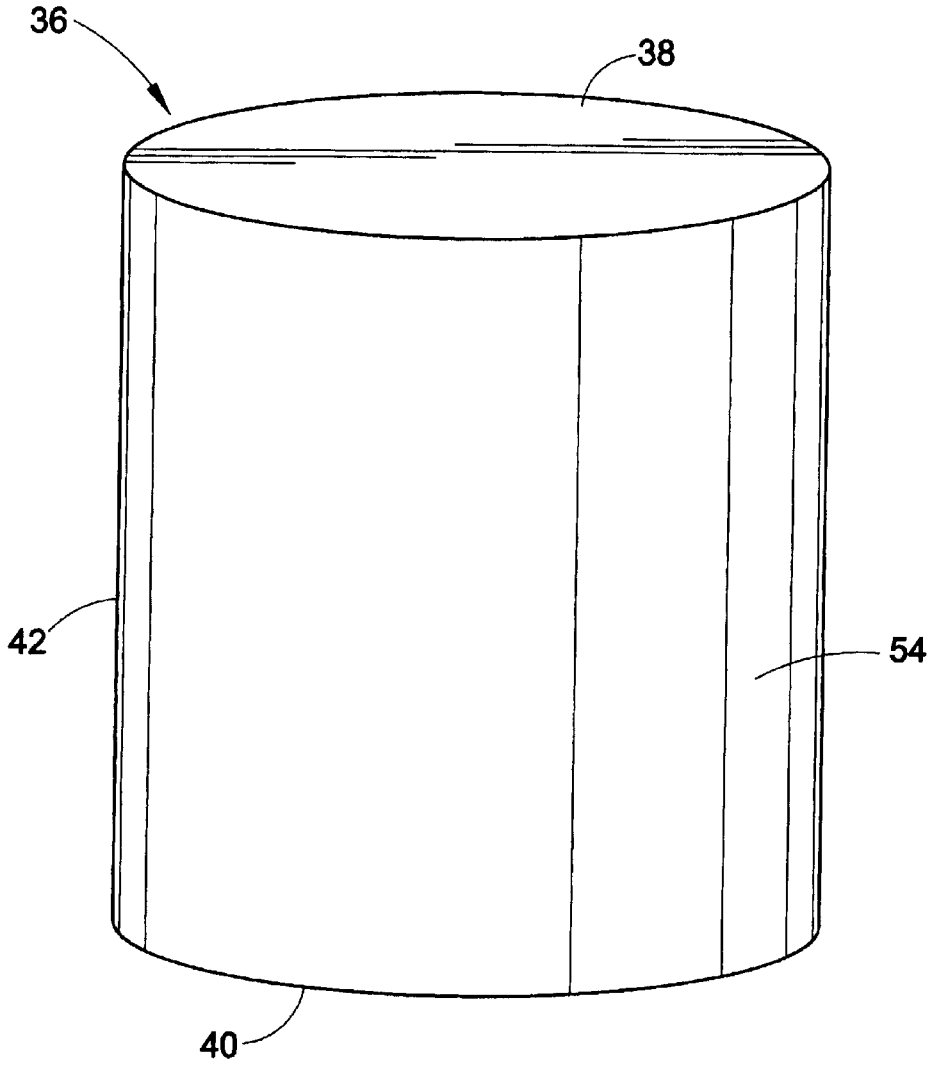
FIG. 2 is a perspective view of an alternate embodiment of a cathode fabricated entirely of a diamond material.

The cathode 36 includes an inner core 52 coated with a diamond material 54. The inner core preferably has a cylindrical configuration and is fabricated from a material upon which carbides, such as diamond, grow easily. In a preferred embodiment, the diamond material is formed through the process of chemical vapor deposition (CVD). However, it must be understood that several types of diamond material formed in any suitable manner is within the scope and intent of the present invention. With reference to FIG. 2, an alternate embodiment is illustrated wherein the cathode 36 is constructed entirely of a diamond material, rather than being merely coated with a diamond material.

In particular, with reference to FIG. 2 a cathode 36' optionally replaces the cathode 36. The cathode 36' includes upper and lower axial ends 38', 40' corresponding to the upper and lower axial ends 38, 40 of the cathode 36. The cathode 36' also includes a concentric sidewall 42' corresponding to the concentric sidewall 42 of the cathode 36. However, in place of the inner core 52 and coating of diamond material 54 of the cathode 36 in FIG. 1, the cathode 36' includes a single cylindrical piece 54' constructed entirely of a diamond material.

Returning back to FIG. 1, a thermionic heat source comprising a filament 58 and a second voltage 60 is optionally provided. The filament preferably includes a coiled wire made from a metallic material, such as tungsten, which spirals around the cathode. The use of a coil increases the surface area of the filament and therefore the electron emitting properties of the filament. However, it must be understood that any suitable filament is contemplated by the present invention.

In operation, the magnetron device may be started using thermionic emission or field emission. When using thermionic electron emission, a current is applied to the filament 58 from the second voltage 60 which heats the filament to an elevated temperature. By heating the filament, sufficient energy is provided to allow electrons to escape from the filament and start operation of the magnetron device. Alternatively, field emission may be used to start the device. When field emission is used, a strong electric field is applied to the diamond material which causes electrons to emit from the cathode. Because diamond has a relatively low work function (quantity of energy required to emit an electron), it is possible to start the magnetron device by merely using field emission rather than thermionic emission. In such a configuration, the provision of a thermionic heat source (i.e. filament 58 and second voltage 60) is not necessary.

The emitted electrons produced by either thermionic emission or field emission enter the cross-field configuration generated from the electric and magnetic fields 32, 50. The cross-field configuration causes the emitted electrons to rotate azimuthally within the magnetron 10. Electrons with an optimum trajectory travel in a circular pattern and induce RF power in the outer cavities 26 of the magnetron. Electrons with insufficient energy spiral back to the cathode 36 and collide with the diamond material 54 of the cathode. The collision of these electrons with the diamond material causes a plurality of secondary electrons to emit from the diamond material. The secondary electrons are accelerated due to the cross field configuration and become part of the electron cloud.

Because the secondary electron co-efficient (the number of secondary electrons that are produced due to a single electron impinging on the cathode surface) of diamond is relatively high, the magnetron device is capable of relying entirely on secondary electron emission to emit a sufficient quantity of electrons to sustain operation. Diamond materials can obtain a secondary electron co-efficient of about 60. In other words, about 60 electrons are emitted each time one electron impinges on the cathode surface. Thus, a thermionic heat source is not required to sustain operation of the magnetron. Furthermore, the need for a thermionic heat source is completely eliminated when field emission is used to start the magnetron device. To further enhance the secondary electron yields, the diamond material may be doped with at least one of a cesium source and a boron source.

The elimination or minimization of the need for a heat source is a significant improvement over known prior art magnetrons which employ a tungsten filament as the cathode. Tungsten has a secondary electron co-efficient of only 2. Therefore, secondary electron emission provides only approximately 60% of the overall electron emission needed to sustain operation. The cathode must be continuously heated in order to produce the remaining electrons needed for effective operation. However, the continuous use of a heater is relatively expensive, especially when used in magnetrons directed for space applications or residential appliances requiring high input power, such as clothes dryers. Thus, eliminating the need to continually provide heat to the cathode provides significant cost advantages. Furthermore, eliminating the need for a heat source provides for a longer magnetron life, elimination of warm-up delays, and reduction of ancillary equipment, such as peripheral cooling systems.

Another significant benefit resulting from the use of the diamond material 54 as the cathode 36 is that the magnetron can operate with minimal electron noise. Known magnetron devices lack a well defined emission because electrons emerge from the cathode surface at various angles to the surface normal. This causes crossing of electron trajectories on a microscopic scale. As a result, the signal and the power generated have an abundance of electron noise which prevents the use of RF magnetrons in space applications. In the present magnetron device, the diamond is preferably formed through the process of chemical vapor deposition. Through such a process, it is relatively easy to form and alter the surface of the diamond material to achieve a well defined electron emission. Therefore, electron noise is minimized.

Thus, it is apparent that there has been provided, in accordance with the present invention, a radio frequency magnetron device which fully satisfies the objects, aims and advantages set forth above. While the invention has been described in conjunction with specific embodiments thereof, it is evident that many alternatives, modifications, and variations will be apparent to those skilled in the art. In light of the foregoing description, accordingly, it is intended to embrace all such alternatives, modifications, and variations as fall within the spirit and broad scope of the appended claims.

What is claimed is:

1. A radio frequency (RE) magnetron device for generating microwave power comprising:

a cathode either partially or entirely comprised of a diamond material, the diamond material configured to emit electrons and sustain operation of the magnetron device via secondary electron emission and without assistance of a heating source, the cathode having a generally smooth surface;

an anode disposed concentrically around the cathode, an electric field provided radially between the anode and the cathode; and first and second oppositely charged pole pieces operatively connected to the cathode for producing a magnetic field in a direction perpendicular to the electric field.

2. The magnetron device according to claim 1, wherein the cathode is formed entirely from a diamond material.

3. The magnetron device according to claim 1, wherein the cathode is comprised of a carbide growth facilitating material coated with the diamond material.

4. The magnetron device according to claim 1, further comprising a plurality of walls extending from the anode, the plurality of walls sectioning an annular recess defined by the anode and the cathode into a plurality of cavities.

5. The magnetron device according to claim 1, further comprising a thermionic emission source for initiating electron emission within the magnetron device, said thermionic emission source being deactivated after initiation of electron emission, and operation of the magnetron being sustained without assistance of the thermionic emission source.

6. The magnetron device according to claim 5, wherein the thermionic emission source comprises a filament which is heated, thereby causing electrons to emit from the filament.

7. The magnetron device according to claim 1, wherein the diamond material is a chemical vapor deposited material.

8. The magnetron device according to claim 1, wherein the diamond material is doped with at least one of a cesium source and a boron source for enhancing the secondary electron emission of the magnetron device.

9. A secondary electron emitting device for a magnetron comprising:

a cathode either partially or entirely comprised of a diamond material, the diamond material configured to emit electrons and sustain operation of the magnetron via secondary electron emission without assistance of a heating source; and an anode in spaced relation with the cathode.

10. The secondary electron emitting device as set forth in claim 9, wherein the diamond material has a secondary electron coefficient greater than 50.

11. The secondary electron emitting device according to claim 9, wherein an electric field is provided between the cathode and the anode.

12. The secondary electron emitting device according to claim 11, further comprising first and second oppositely polarized magnets operatively connected to the cathode for producing a magnetic field in a direction perpendicular to the electric field.

13. The secondary electron emitting device according to claim 10, wherein the cathode is formed entirely from a diamond material.

14. The secondary electron emitting device according to claim 9, wherein the cathode is comprised of a carbide growth facilitating material coated with the diamond material.

15. The secondary electron emitting device according to claim 9, further comprising a plurality of walls extending from the anode, the plurality of walls sectioning an annular space defined by the anode and the cathode into a plurality of cavities.

16. The secondary electron emitting device according to claim 9, further comprising a thermionic emission source for initiating electron emission, said thermionic emission source being deactivated after initiation of electron emission, secondary electron emission being sustained without assistance of the thermionic emission source.

17. The secondary electron emitting device according to claim 16, wherein the thermionic emission source comprises a filament which is heated, thereby causing electrons to emit from the filament.

18. The magnetron device according to claim 9, wherein the diamond material is a chemical vapor deposited material.

19. The secondary electron emitting device according to claim 9, wherein the diamond material is doped with a cesium source for enhancing the secondary electron emission of the magnetron device.

20. A method for producing radio frequency power using a magnetron device comprising the steps of:

coating a substantially cylindrical cathode with a diamond material;

placing an anode in a spaced relationship with the diamond coated cathode;

applying an electric field between the anode and the cathode;

emitting primary electrons from the cathode for initiating operation of the magnetron device; and emitting secondary electrons from the cathode for sustaining operation of the magnetron device, the emitting of secondary electrons responsive to the emitting of the primary electrons.

21. The method according to claim 20, wherein the step of emitting secondary electrons further includes colliding a portion of the primary electrons with the cathode thereby producing the secondary electrons.

22. The method according to claim 20, wherein the step of emitting primary electrons further includes heating a filament in order to thermionically generate the primary electrons.

23. The method according to claim 20, wherein the step of emitting primary electrons includes applying a voltage to the diamond material to cause primary electrons to emit from the cathode by field emission.

* * * * *